US005234507A

United States Patent [19]

Sato et al.

[11] Patent Number: 5,234,507

[45] Date of Patent: Aug. 10, 1993

[54] ANTI-OXIDANT AGENT FOR CONTINUOUS ANNEALING OF STAINLESS STEEL STRIP AND ANTI-OXIDATION METHOD USING THE SAME

[75] Inventors: Kuniaki Sato; Genichi Ishibashi; Yasuhiro Katsuki; Hiroyuki Kaito, all of Chiba; Hisatomi Muraki; Yoshiharu Yamaguchi, both of Yokkaichi, all of Japan

[73] Assignee: Kawasaki Steel Corporation, Hyogo, Japan

[21] Appl. No.: 727,543

[22] Filed: Jul. 9, 1991

[30] Foreign Application Priority Data

Jul. 12, 1990 [JP] Japan ..... 2-184531
Jul. 12, 1990 [JP] Japan ..... 2-184532

[51] Int. Cl.[5] ..... B23K 35/34
[52] U.S. Cl. ..... 148/28
[58] Field of Search ..... 148/22-28

[56] References Cited

U.S. PATENT DOCUMENTS 4,130,423 12/1978 Chastant ..... 148/26
4,740,251 4/1988 Howe ..... 148/27

*Primary Examiner*—Peter D. Rosenberg
*Attorney, Agent, or Firm*—Bierman and Muserlian

[57] ABSTRACT

An anti-oxidation agent for preventing oxidation of a stainless steel strip during continuous annealing comprising a colloidal inorganic substance which can be crystallized at a temperature not higher than 1300° C. at least one compound having a melting point not higher than 1300° C., selected from the group consisting of silicates, borates and phosphates, a dispersion agent, and the balance substantially water. The anti-oxidation agent is applied to the surface of the stainless steel strip. During the annealing, the anti-oxidation agent enhances the heat absorption so that the stainless steel strip temperature is elevated to the annealing temperature in a short time. The anti-oxidation agent on the strip surface forms a film of a fine structure which keeps the strip surface away from oxidizing components of the annealing atmosphere so as to suppress generation of oxide scale. The film is easily separated due to thermal contraction in the course of the cooling after the annealing.

8 Claims, 6 Drawing Sheets

ANTI-OXIDANT AGENT FOR CONTINUOUS ANNEALING OF STAINLESS STEEL STRIP AND ANTI-OXIDATION METHOD USING THE SAME

BACKGROUND OF THE INVENTION

Field of the Invention

The present invention relates to an anti-oxidation agent for preventing generation of oxide scale on the surface of a stainless steel strip under a continuous annealing after a cold rolling. The invention also relates to a continuous annealing method which uses the anti-oxidation agent of the invention.

Description of the Related Art

It is a known technique to effect annealing on cold-rolled stainless steel strip, in order to attain required mechanical properties. Such annealing is ordinarily carried out in a continuous annealing/pickling line which conducts annealing and pickling. FIG. 6 shows a typical example of conventional continuous annealing-/pickling line (referred to as "APL"). Referring to the drawings, the APL has a pay-off reel 1, an inlet shear 2, a welder 3, a degreasing device 4 and an inlet looper 5. Numeral 6 denotes an annealing furnace which has a heating portion 7 and a cooling portion 8. The heating portion includes a pre-heating zone, a heating zone and a soaking zone. Numerals 9, 10 and 11 denote a plurality of pickling tanks including, in combination, a salt bath, a neutral electrolytic bath, nitric acid bath and nitro-fluoric acid bath. The APL further has a rinsing device 12, a drier 13, an outlet looper 14, a dividing shear 15 and a tension reel 16.

In operation of the APL, a stainless steel strip S after cold rolling is unwound by the pay-off reel 1, is cut at its leading or trailing end by the inlet shear 2 and is welded to a preceding or following coil by the welder 3. Subsequently, a cold-rolling oil deposited on the surface of the stainless steel strip S is removed by a degreasing device 4. The stainless steel strip S is then fed through the inlet looper 5 into an annealing furnace 6 where a predetermined heat-treatment is executed. More specifically, in the heating portion 7 of the annealing furnace 6, the stainless steel strip S is supported in a catenary-like fashion by hearth rolls 71 and is directly heated by a burner. Subsequently, the stainless steel strip S is cooled in the cooling portion of the annealing furnace 6 by an air jet. As a result of the direct heating by the burner, i.e., as the annealing is effected in the atmosphere of combustion gas, a layer of fine scales of 200 to 4000 Å thick is formed on the surface of the stainless steel strip S. Subsequently, the stainless steel strip S is descaled through the plurality of pickling tanks 9 to 11 so as to be passivated. The stainless steel strip S is then made to move through the rinsing device 12 which cleans the strip surface by brushing and spraying and, after being dried by the drier 13, introduced through the outlet looper 14 into the dividing shear 15 which shears the strip at a predetermined length. The strip is then taken up by the tension reel 16.

The surface of the stainless steel strip S after the cold rolling exhibits a low heat absorption because it has been almost mirror-finished. Consequently, the annealing furnace is required to have a large length or the velocity of the strip passing through the furnace has to be decreased so that the stainless steel strip S is heated to the annealing temperature in the heating portion 7 of the annealing furnace 6 of the APL.

A known method for overcoming this problem is disclosed in, for example, Japanese Patent Publication No. 56-8092. In this method, one or more of carbon, a black dye and a black pigment are applied to the surface of the cold-rolled steel strip so as to enhance heat absorption during cold rolling.

The method disclosed in Japanese Patent Publication No. 56-8092 can enhance the rate of heat absorption of the steel strip and, hence, the annealing effect.

However, as stated at line 32, column 2 of the above-mentioned publication, the applied film is decomposed within the furnace. That is, the surface of the stainless steel strip is undesirably contacted by the combustion gas atmosphere. This method, therefore, cannot suppress generation of oxide scale on the stainless steel strip in the annealing furnace.

Various problems have been posed by the generation of oxide scale on the stainless steel strip surface during the annealing.

(1) The oxide scale generated on the stainless steel strip during annealing is deposited to a hearth roll in the furnace and grows up to cause pick-up defects on the stainless steel strip. To avoid this problem, a frequent change of the hearth roll is necessary, with the result that the production efficiency is impaired and laborious maintenance work is required.

(2) Oxide scale generated on a stainless steel strip is finer in construction than carbon steels and a huge pickling equipment is necessary to remove such fine oxide scale. Furthermore, the pickling inevitably employs a greater number of type of chemicals, posing problems concerning disposal of the waste solutions.

(3) Usually, rolling oil remains on the surface of a stainless steel strip after cold rolling. If the strip is subjected to a continuous annealing without removing the rolling oil, oxide scale is formed non-uniformly due to non-uniform deposition of the rolling oil, resulting in a non-uniform state of the strip surface after the annealing. It is therefore necessary that the stainless steel strip is subjected to degreasing in advance of the annealing. It is to be understood, however, the degreasing equipment is not always installed in the annealing equipment or APL. When the degreasing equipment is installed externally of the annealing equipment or APL, it is necessary to pass the stainless steel strip through such a separate degreasing equipment.

(4) The continuous annealing has to be essentially followed by pickling. The pickling solution usually corrodes not only the oxide scale but also the matrix metal. Consequently, the pickled stainless steel strip exhibits an inferior gloss on the finished surface. The surface gloss would be enhanced by reducing the pickling. Such a measure, however, has not been put to practical use.

SUMMARY OF THE INVENTION

Accordingly, an object of the present invention is to provide an anti-oxidation agent which can improve the efficiency of heat treatment of the stainless steel strip while suppressing generation of oxide scale, as well as an annealing method which uses such an anti-oxidation agent, thereby overcoming the above-described problems of the known arts.

To this end, according to one aspect of the present invention, there is provided an anti-oxidation agent for stainless steel strip comprising a colloidal inorganic substance which can be crystallized at a temperature not higher than 1300° C.; at least one compound having a melting point not higher than 1300° C. selected from the group consisting of silicates, borates and phosphates; a dispersion agent; and the balance substantially water.

The anti-oxidation agent of the present invention may further contain, as an effective component, at least one kind of refractory material.

According to another aspect of the present invention, there is provided an anti-oxidation method for preventing oxidation of a stainless steel strip during continuous annealing comprising: applying to the surface of the stainless steel strip an anti-oxidation agent comprising a colloidal inorganic substance which can be crystallized at a temperature not higher than 1300° C., at least one compound having a melting point not higher than 1300° C. selected from the group consisting of silicates, borates and phosphates, a dispersion agent, and the balance substantially water; annealing the stainless steel strip under predetermined heat-treating conditions in a combustion gas atmosphere; and removing the fired film of the anti-oxidation agent formed on the surface of said stainless steel strip.

Preferably, rolling oil and other residue on the stainless steel strip are removed to clean the strip surface before the application of the anti-oxidation agent.

The above and other objects, features and advantages of the present invention will become clear from the following description of the invention when the same is read in conjunction with the accompanying drawings.

BRIEF DESCRIPTION OF THE DRAWINGS

FIG. 2(*b*) is an enlarged sectional view of a fired film removing device incorporated in the apparatus shown in FIG. 1;

DETAILED DESCRIPTION OF THE INVENTION

Figure 1:
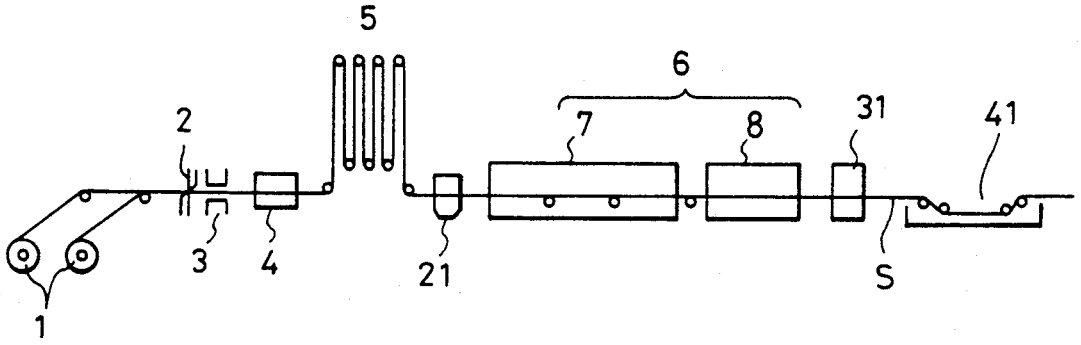
FIG. 1 is a schematic illustration of an apparatus for conducting continuous annealing of a stainless steel strip in accordance with the anti-oxidation method of the present invention.

Colloidal inorganic substance composed of very tiny particles, when applied to the surface of the steel strip, enhances the efficiency of heat absorption by the steel strip surface which is almost mirror-finished and, hence, has a very small heat absorption. In addition, the colloidal inorganic substances increase the seeming heat-receiving area. As a consequence, the rise of the temperature of the stainless steel strip in the annealing furnace is promoted. The colloidal particles are dehydrated at temperatures between about 300° C. and 600° C. and, at 600° C. or higher temperatures, the particles are condensed to form a strong and fine infinite form film which welds to the surface of the steel strip surface. This film effectively insulates the strip surface from oxidizing atmosphere thereby preventing generation of scale.

A further temperature rise causes the infinite form film to be crystallized to form a finite form film. This finite form film has a linear thermal expansion coefficient smaller than that of the steel strip. Therefore, in the subsequent cooling step, minute cracks are formed in the film due to differences in the amount of contraction between the steel strip and the film. The film, therefore, can easily be removed from the steel strip surface merely by rinsing with water and brushing.

The low-melting-point compound having a melting point of 1300° C. or below comprising at least one member selected from the group consisting of silicates, borate and phosphate, when added to colloidal inorganic substance, causes a change in the temperature at which the infinite form film is formed and also in the crystallization temperature of the colloidal inorganic substance. By adjusting the amount of such a low-melting-point compound, it is possible to control the thermal characteristics of the colloidal inorganic substance.

The dispersion agent comprises of an organic polymer which promotes the dispersion of particles of the colloidal inorganic substance so as to promote formation of uniform and smooth dry coat of colloidal inorganic material on the steel strip surface, thus enhancing the affinity between the film and the steel strip.

The refractory material also contributes to the prevention of generation of oxide scale, particularly when the annealing is effected for a long time at high temperature.

The invention will be described in more detail hereinunder.

In general, the annealing temperature in continuous annealing of a steel strip is 1300° C. or below. For instance, the annealing temperature is between 1120° C. and 1200° C. in the case of stainless steel SUS 304 and between 800° and 900° C. in the case of stainless steel SUS 430.

The present inventors, therefore, have conducted an intense study to obtain an anti-oxidation agent which meets all the following conditions at temperatures not higher than 1300° C., thus accomplishing the present invention.

(1) The agent should exhibit a large initial bonding strength to the steel strip when applied and should be resistant to cracking and exfoliation in the state of dried film.

(2) In order to prevent invasion of oxygen which is the major cause of generation of oxide scale, the agent should be molten and welded to the steel strip surface so as to form a fired film which has a fine structure and which has a large strength of bonding to the steel strip surface.

(3) The agent should exhibit a large difference in the thermal contraction from the steel strip so as to show a drastic reduction in the bonding strength to the steel strip in the course of cooling, thereby enabling a complete separation of the fired film.

The anti-oxidation agent of the present invention for stainless steel strip contains a colloidal inorganic substance. Preferably, the colloid component is at least one member selected from the group consisting of alumina, silica, aluminum phosphate, zirconium silicate and zirconium borate, since these colloidal substances are thermally stable and are crystallized at temperatures below 1300° C.

The functions of the colloidal inorganic substance in the anti-oxidation agent of the present invention are as follows:

(a) In general, a colloidal inorganic substance is composed of very fine particles having particle sizes ranging between $5\times10^{-3}$ μm to $100\times10^{-3}$ μm. Therefore, this substance, when applied to the surface of a steel strip, forms a layer which has a fine structure and which has microscopic convexities and concavities. As a result, the heat absorption by the mirror-surface of the stainless steel strip after a cold rolling, which inherently has a small heat absorption, is enhanced. In addition, the effective heat-receiving area of the steel strip is enhanced. As a consequence, the steel strip can be easily and promptly heated up to the annealing temperature. This eliminates the necessity for a long furnace and reduction in the velocity of passage of the strip through the furnace, thus obviating the problem concerning reduction in the production efficiency.

(b) During the rise of the temperature of the steel strip in the annealing furnace, the water or moisture component of the colloidal inorganic particle is removed: namely, the colloidal inorganic particles are dehydrated at temperatures between about 300° C. and 600° C. At temperatures of 600° C. or higher, the particles are condensed to form a strong infinite form film. This infinite form film covers the surface of the stainless steel strip to protect the strip from oxidizing components in the annealing atmosphere, e.g., $O_2$, $CO_2$, and $H_2O$, whereby the generation of the oxide scale in the furnace is prevented.

(c) A further rise of the steel strip temperature causes the infinite form film to be changed into a regular finite form film, i.e., crystallized. This stable film has a linear thermal expansion coefficient which is much smaller than that of the stainless steel strip. In the subsequent cooling step, therefore, a large thermal stress is generated in the film due to the difference in the amount of thermal contraction between this film and the stainless steel strip, whereby cracks are generated in the film.

The finite form film of the colloidal inorganic substance after the cooling, which has been cracked as described above, can easily be removed from the stainless steel strip surface by a mere water rinsing and brushing.

As has been described, the colloidal inorganic substance of the present invention has to be crystallized in the course of annealing. The crystallization temperature, therefore, has to be not higher than 1300° C. which is the upper limit of the annealing temperature. The crystallization temperature preferably ranges between 750° C. and 1300° C.

When the film of the colloidal inorganic substance is not crystallized at temperature below 1300° C., the film remains on the surface of the stainless steel strip surface in a molten state, making it difficult to separate the film in the course of cooling.

Preferably, the content of the colloidal inorganic substance ranges between 25 and 45% by weight.

The anti-oxidation agent of the invention for stainless steel strip may contain, in addition to the above-mentioned colloidal inorganic substance, at least one low-melting-point compound having a melting point not higher than 1300° C., selected from the group consisting of silicate, borate and phosphate. By adjusting the composition ratio of the agent through the addition of such a compound, it is possible to optimize the thermal properties of the colloidal inorganic substance for the type of the stainless steel strip.

More specifically, in general, continuous annealing is conducted for a variety of types of stainless steel strip, so that the annealing temperature varies over a wide range, for example, from 750° C. to 1300° C., in accordance with the type of the stainless steel strip. The thermal properties of the colloidal inorganic substance such as the "temperature at which infinite form film formed through condensation" and the "crystallization temperature at which the film is changed into finite form film", are to be changed in accordance with the annealing temperature of the stainless steel strip to be obtained.

The present inventors have conducted various studies on the thermal properties of the stainless steel strip and has discovered the following facts. Namely, by adding to the colloidal inorganic substance a low-melting-point compound or compounds having a low-melting-point not higher than 1300° C. selected from alkali metal salts or alkaline earth metal salts such as silicate, borate and phosphate, and by varying the composition ratio of the agent through variation of the amount of such compound or compounds, it is possible to easily change the above-mentioned two factors of the thermal properties of the colloidal inorganic substance.

Figure 3:
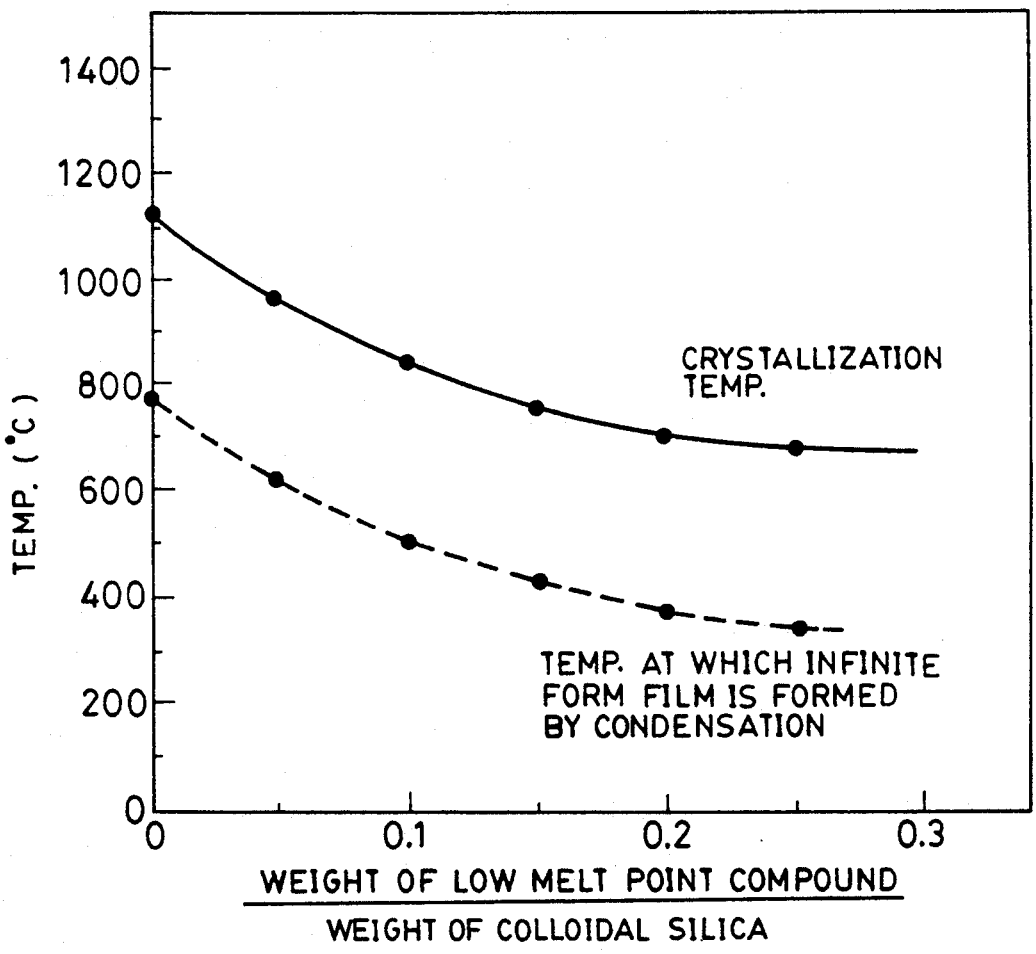
FIG. 3 is a graph showing thermal characteristic of an anti-oxidation agent of the present invention.

FIG. 3 shows, by way of example, a change in the thermal properties of colloidal silica as an example of the colloidal inorganic substance as observed when the composition ratio of the agent is changed by addition of a low-melting-point compound at a varying ratio. From this Figure, it will be seen that both the "temperature at which the infinite form film is formed by condensation" and the "crystallization temperature at which the film is changed into a finite form film" are progressively lowered in accordance with an increase in the content of the low-melting-point compound.

The low-melting-point compound having a melting point not higher than 1300° C., when added to the colloidal inorganic substance, enhances the strength of bonding of the film of the colloidal inorganic substance to the stainless steel strip which is being heated and also contributes to refining of the structure of the film thereby enhancing the effect to suppress generation of the oxide film.

Preferably, the content of the silicate, borate and/or phosphate in total ranges between 1 and 25% by weight.

The anti-oxidation agent of the invention for the continuous annealing of stainless steel strip further contains a suitable amount of dispersion agent to obtain a uniform and macroscopically smooth dried coat film (the film has microscopically fine convexities and concavities.). The present inventors have confirmed, through experiments, that good results are obtained when the dispersion agent is selected from the group consisting of organic polymers: corn starch; tapioca starch; sodium alginate; guar gum; xanthane gum, casein; gelatin; α-starch; dextrin; methylcellulose; ethylcellulose; hydroxy ethylcellulose; carboxymethyl cellulose; hydroxymethylpropyl cellulose; polyvinylalcohol; polypropylene glycol; polyethylene oxide; polyvinyl butyral and pullulan.

Uniform and smooth dried film of colloidal inorganic substance cannot be obtained unless the dispersion agent is used. In addition, lack of dispersion agent reduces the bonding strength of the film to the surface of the stainless steel strip so as to allow separation of the infinite form film before the film is formed.

Preferably, the content of the dispersion agent ranges between 1 and 5% by weight.

The anti-oxidation agent of the invention may further contain a refractory material as an effective component. Such effective component contributes to prevention of generation of oxide scale, particularly when the annealing is conducted for a long time at high temperature.

The refractory material is preferably a non-metallic inorganic matter which can sustain a high temperature and which is chemically stable. The refractory material, therefore, is selected from the group consisting of alumina, silica, magnesia, zirconia and titania. The refractory material also may be selected from the group consisting of composite oxides consisting of mullite, andalusite, chamotte, magnesite, spinel, dolomite, momtmorillonite, kaolinite and sepiolite.

The refractory material also maybe a carbide selected from the group consisting of silicon carbide, titanium carbide, tungsten carbide, boron carbide and molybdenum carbide.

Preferably, the refractory material has a mean particle size not greater than 10 μm, so that it is uniformly dispersed in the film of the colloidal inorganic substance. Refractory material having a mean particle size exceeding 10 μm tends to be deposited on the surface of hearth rolls in the annealing furnace so as to cause defects on the surface of the stainless steel strip. The above-mentioned particle size of the refractory material, however, is not essential.

According to the invention, a stainless steel strip having the anti-oxidation agent of the described composition is annealed under a predetermined heat-treating condition in an atmosphere of combustion gases, so that an infinite form film of the anti-oxidation agent is formed at temperatures above 600° C. This film effectively suppresses generation of oxide scale on the strip surface within the annealing furnace, so that the necessity for a long pickling line which has been heretofore necessary for removing oxide scale can be eliminated. In addition, the problem concerning pick-up defects due to deposition of hard matter on the hearth rolls is also overcome.

As the stainless steel strip is heated to a higher temperature (crystallization temperature), the infinite form film of the anti-oxidation agent is changed into a finite form film.

In the subsequent cooling step, cracks are generated in the finite form film due to differences in the amount of thermal contraction between the steel strip and the film. The film, therefore, can easily be removed from the surface of the stainless steel strip in the subsequent step for removing the anti-oxidation agent film.

The anti-oxidation agent of the present invention is mainly composed of oxides so that it is thermally stable and, hence, does not grow through reaction with the roll material. Thus, the risk of damaging the stainless steel strip surface due to deposition and growth of the anti-oxidation agent in the furnace rolls is completely avoided.

When annealing is conducted while rolling oil is deposited on the surface of the stainless steel strip, oxide scale is formed non-uniformly on the surface of the steel strip, allowing a non-uniform surface state to be generated after the pickling. Hitherto, therefore, it has been necessary to clean the strip surface by degreasing in advance of the annealing. In contrast, in the method of the present invention, an anti-oxidation agent is applied to the surface of the stainless steel strip. It is therefore possible to prevent generation of oxide scale due to uneven deposition of rolling oil and, hence, to prevent any non-uniform surface state to appear after the pickling. The cleaning of the strip surface before the annealing is therefore unnecessary if the cleaning is intended solely for the purpose of elimination of non-uniform surface state. The rolling oil remaining on the stainless steel strip, however, tends to cause winding of the steel strip on the inlet looper which is installed at the inlet end of the annealing furnace.

It is therefore preferred to clean the stainless steel strip surface by removing any residual rolling oil before the stainless steel strip is introduced into the annealing furnace to prevent the strip from winding.

These and other objects, features and advantages of the present invention will become clear from the following description of the preferred embodiments taken in conjunction with the accompanying drawings.

DESCRIPTION OF THE PREFERRED EMBODIMENTS

Figure 6:
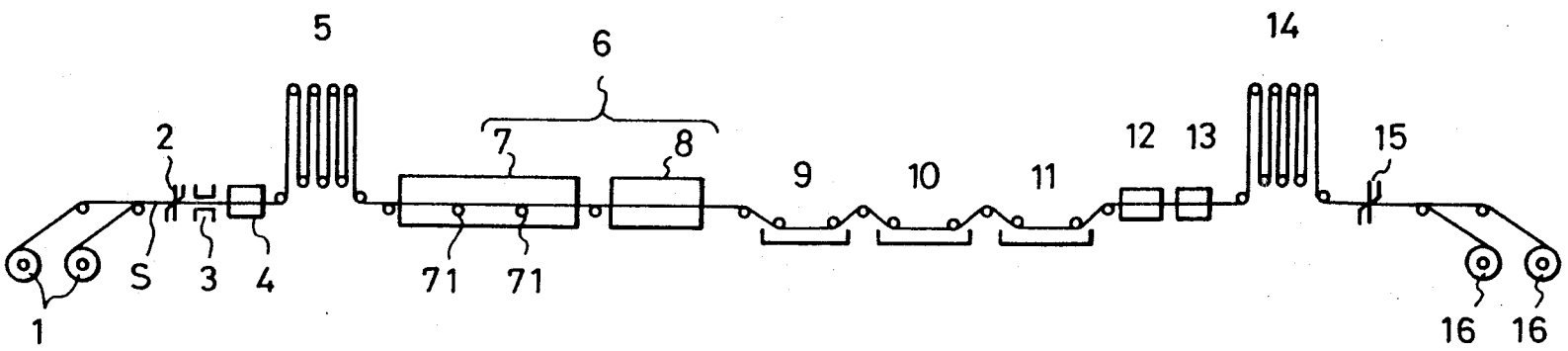
FIG. 6 is a schematic illustration of a conventional annealing apparatus for stainless steel strip.

FIG. 1 is an illustration of an essential portion of a continuous annealing apparatus suitable for carrying out the method of the present invention. Components of the apparatus downstream of the pickling tank, however, are omitted from the illustration. In FIG. 1, the same reference numerals are used to denote the same or equivalent components as those in FIG. 6 showing the conventional continuous annealing apparatus, and detailed description of such components is omitted to avoid duplication of explanation.

Figure 2:
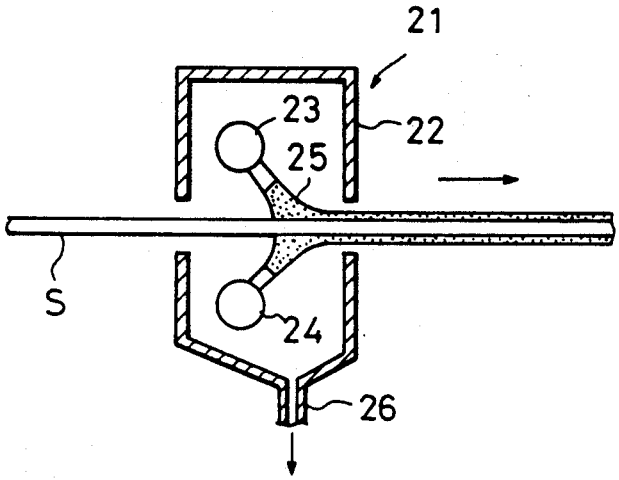
FIG. 2(*a*) is an enlarged sectional view of an apparatus for applying an anti-oxidation agent.
Figure 2:
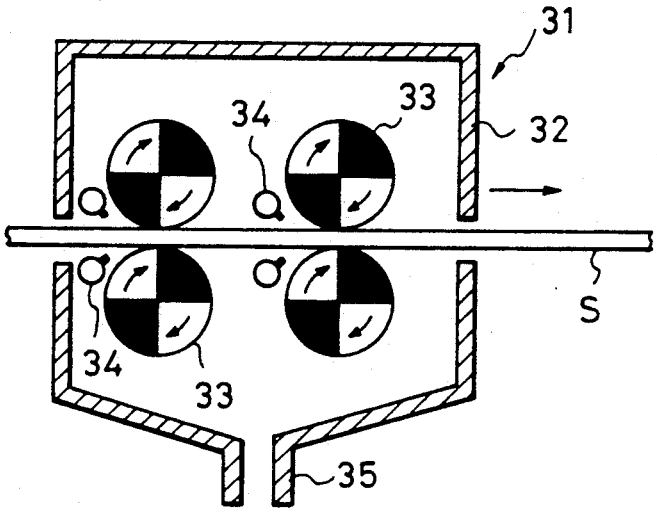

Referring to FIG. 1, numeral 21 designates a device for applying the anti-oxidation agent, disposed at the inlet side of the annealing furnace 6, while 31 designates a device for removing anti-oxidation film formed by firing in the annealing furnace 6. FIG. 2(*a*) shows the detail of the anti-oxidation agent application device 21. Spray nozzles 23 and 24 are disposed across the stainless steel strip S within a hood 22 so as to face the major surfaces of the strip S. The nozzles 23 and 24 spray the anti-oxidation agent 25 so as to apply this agent to the obverse and reverse sides of the stainless steel strip S. Any portion of the anti-oxidation agent 25, which failed to attach to the strip surfaces, drops onto the bottom of the hood 22 and is returned to a storage tank (not shown) through a return pipe 26.

FIG. 2(*b*) shows the detail of the device 31 for removing anti-oxidation film. This device 31 has a pair of nylon brush rolls 33 which are disposed in a hood 32 and which oppose each other across the stainless steel strip S so as to face the major surfaces of the strip S. These nylon brush rolls 33 are adapted to rotate in the direction reverse to the direction of movement of the stainless steel strip S so as to remove crystallized films of the anti-oxidation agent from the strip surfaces. The films can easily be removed because they have been cracked due to thermal stress generated when the stainless steel strip was cooled in the cooling portion 8. Water spray nozzles 34 are disposed in front of the nylon brush rolls 33 so that the residues of the film separated from the strip surfaces are washed away by the water sprayed from the water spray nozzles 34 and are discharged through a drain pipe 35.

In FIG. 1, reference numeral 41 designates a nitric acid tank maintaining a nitric acid bath for forming passivated films on the surface of the stainless steel strip S. The stainless steel strip S is dipped in the bath of the nitric acid tank 41 so as to become resistant to corrosion and is then taken up by a tension reel through a loop which is not shown.

A description will now be given of the results of a test continuous annealing conducted on stainless steel strip by using the apparatus shown in FIG. 1.

Stainless steel strip S (SUS 304, 1.0 mm thick) to which different examples of anti oxidation agent of the present invention were applied and stainless steel strip S of the same type and same thickness with comparative anti-oxidation agents applied thereto were subjected to the test annealing. Both anti-oxidation agents were dissolved in water to form aqueous solutions and these solutions were applied to the respective stainless steel strip by means of the application device 21 mentioned before. The thickness of application was 1 to 2 μm in terms of the thickness of the dried film. The fired films of the anti-oxidation agents after the annealing were removed from the surfaces of the stainless steel strip by means of nylon brush rolls 33.

Compositions in terms of weight percents (wt%), water contents and viscosity levels of the anti-oxidation agents used in the test are shown in Tables 1-1 and 1-2, while the test results are shown in Table 2.

From Table 2, it will be seen that the anti-oxidation agent of the invention is superior both in the effect of preventing oxidation in the furnace and ease of separation of the fired anti-oxidation film after annealing.

Figure 4A:
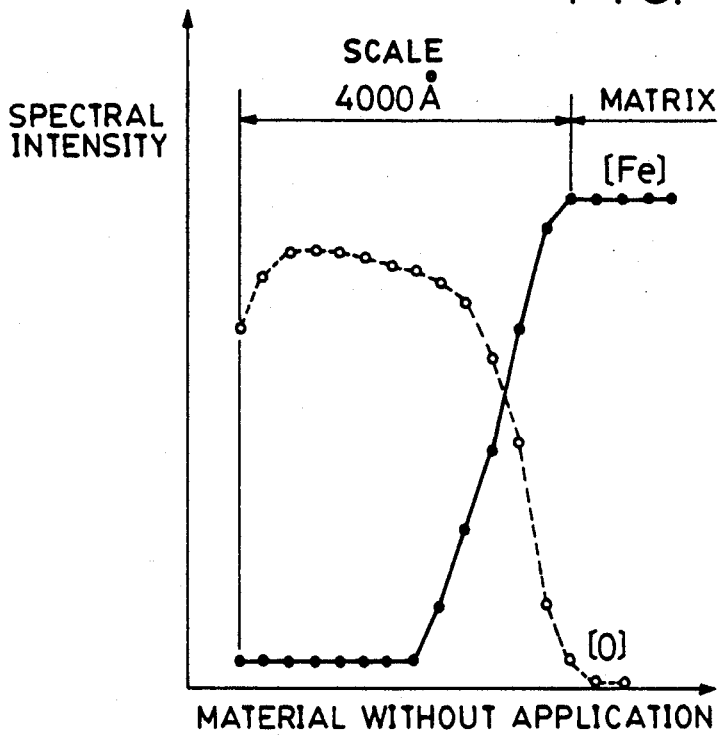
FIGS. 4(*a*) and 4(*b*) are graphs showing the effect of preventing generation of oxide scale produced by the anti-oxidation agent of the present invention, in which FIG. 4(*a*) shows the scale thickness as observed when the anti-oxidation agent of the present invention is not applied and FIG. 4(*b*) shows the scale thickness as observed when the anti-oxidation agent of the present invention is applied.
Figure 4B:
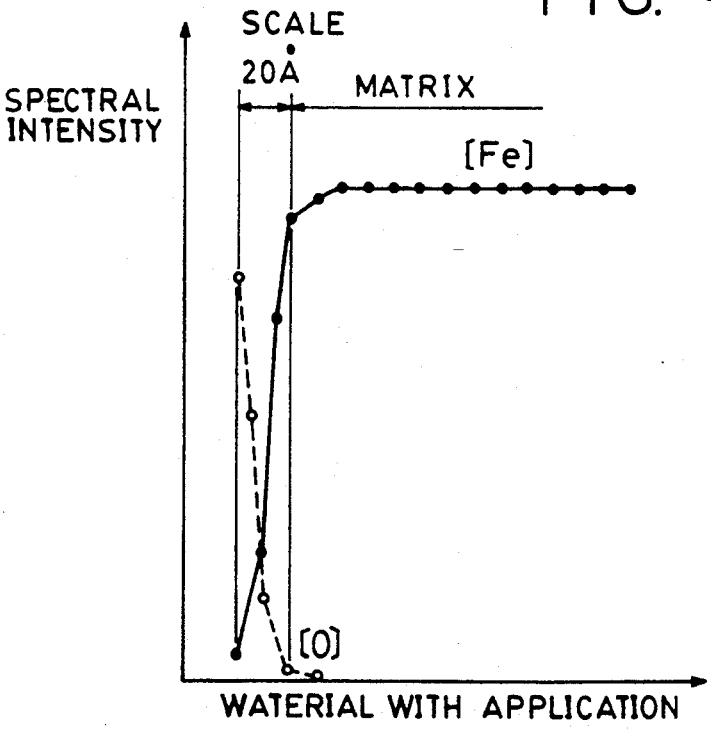

Thicknesses of the oxide scales formed on the steel strip surfaces after annealing were measured by a GDS (Glow Discharge Atomic Emission Spectroscopy) to obtain the results shown in FIGS. 4(*a*) and 4(*b*). More specifically, FIG. 4(*a*) shows the thicknesses as observed when no anti-oxidation agent was applied, while FIG. 4(*b*) shows the thicknesses as observed when the anti-oxidation agent of the present invention was used.

From these Figures, it will be seen that the thickness of the oxide scale is as small as about 20 Å when the anti-oxidation agent of the present invention was used, which should be contrasted to the oxide scale thickness of about 4000 Å observed when no anti-oxidation agent was used. Thus, the thickness of the oxide scale can be reduced to 1/200 by virtue of the use of the anti-oxidation agent of the present invention.

Figure 5:
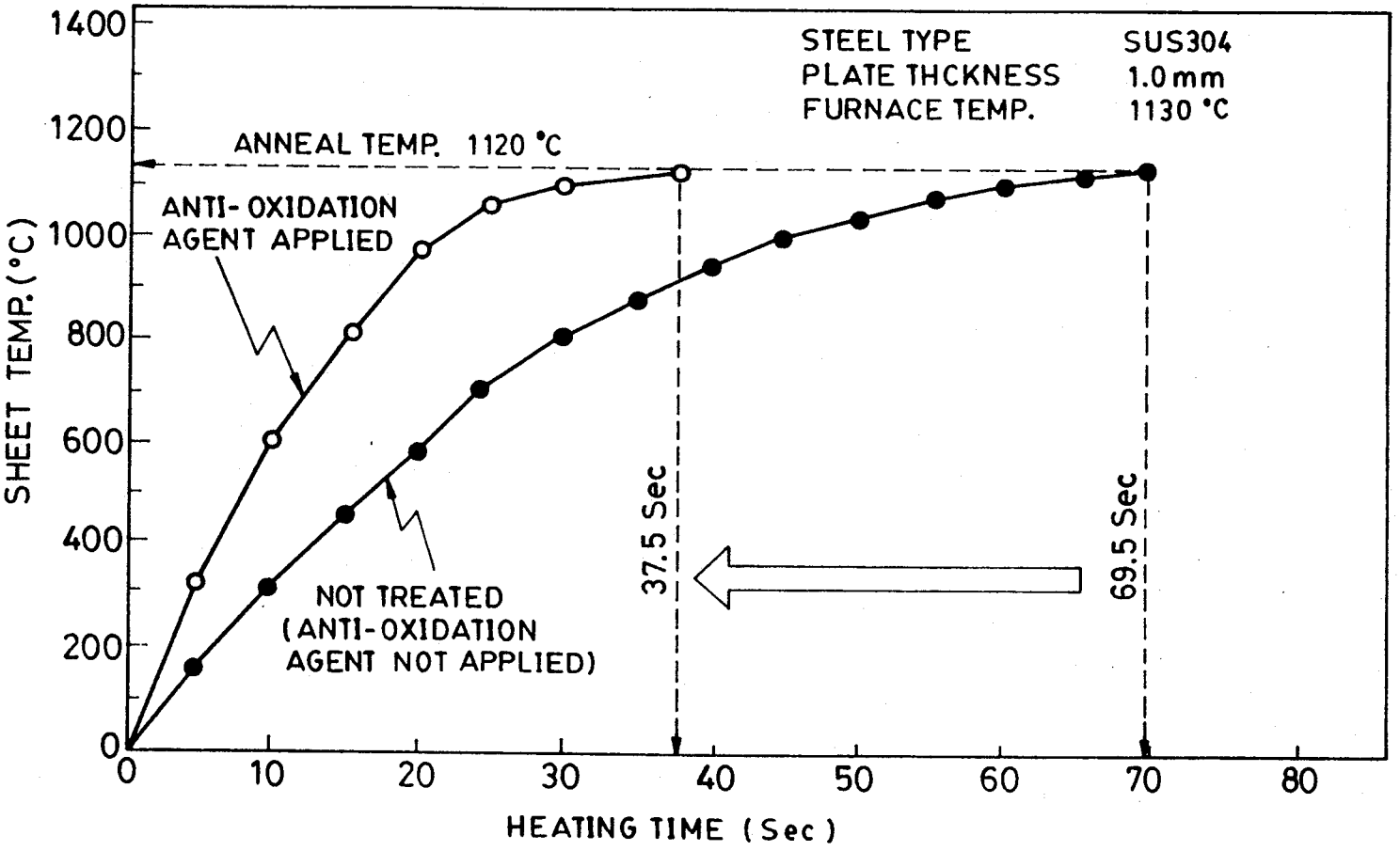
FIG. 5 is a graph showing the relationship between the heating time and the steel strip temperature in an annealing furnace as observed when the anti-oxidation agent of the invention is applied and when the anti-oxidation agent is not applied.

The time required for heating a stainless steel strip up to 1120° C. in an annealing furnace maintaining an annealing atmosphere of 1130° C. was measured by employing a thermocouple. The results are shown in FIG. 5. More specifically, in FIG. 5, a curve plotted on black circles show the temperature rise of a stainless steel strip having no anti-oxidation agent applied thereto, while a curve plotted along white circles shows the temperature rise of a stainless steel strip to which the anti-oxidation agent of the present invention was applied.

From FIG. 5, it will be understood that the stainless steel strip with the anti-oxidation agent of the invention applied thereto exhibits about 45% reduction in the time required for the temperature to rise up to 1120° C. as compared with the stainless steel strip to which no anti-oxidation agent is applied. This means that the length of the annealing furnace or line can be reduced by 45% or the velocity of passage of the stainless steel strip through the annealing furnace can be increased by 1.8 times.

As will be understood from the foregoing description, the present invention provides an anti-oxidation agent which can enhance the heat absorption by a stainless steel strip in a continuous annealing furnace and which can keep the stainless steel strip from any oxidizing component of the annealing atmosphere in the annealing furnace. The anti-oxidation agent is applied to the stainless steel strip at the inlet side of the annealing furnace and a film formed by this anti-oxidation agent is removed from the strip surface at the exit of the annealing furnace. As a consequence, the present invention offers the following advantages.

(1) It is possible to shorten the annealing time or to reduce the length of the annealing furnace.

(2) It is possible to suppress oxidation of the stainless steel strip in the annealing furnace.

(3) It is possible to suppress generation of pick-up defects due to hearth rolls.

(4) The requirement for descaling pickling is reduced to produce advantages such as an increase in the pickling speed, a reduction in the length of the pickling tank, a reduction in the unit cost of acid and a reduction in the running cost of the waste solution disposal system.

(5) The weakened pickling suppresses roughening of the surface of the stainless steel strip.

Various modifications of the agents and method of the invention may be made without departing from the spirit or scope thereof and it is to be understood that the invention is intended to be limited only as defined in the appended claims.

TABLE 1

| | Invention No. | | | | | | | | | | | | | | | |
|---|---|---|---|---|---|---|---|---|---|---|---|---|---|---|---|---|
| Composition | 1 | 2 | 3 | 4 | 5 | 6 | 7 | 8 | 9 | 10 | 11 | 12 | 13 | 14 | 15 | 16 |
| Colloidal inorganic substance | | | | | | | | | | | | | | | | |
| Alumina sol | 30 | 30 | 30 | 30 | 30 | 30 | 30 | | | | | | 10 | | 10 | |
| Silica sol | | | | 10 | | 10 | | 30 | 30 | 30 | 30 | 30 | 30 | 30 | 30 | 30 |
| Zirconium boride | | 5 | | | 5 | | | | | | | 10 | 5 | | 5 | |
| Silicate, Borate, Phosphate | | | | | | | | | | | | | | | | |
| $SiO_2Na_2O$ | 1 | | 1 | | | | | 2 | 2 | | | | | 2 | 1 | |
| $SiO_2K_2O$ | 1 | | 1 | | 5 | 1 | | | | 2 | | 20 | | | 1 | |
| $SiO_2CaO$ | | 2 | | 1 | | 1 | | 1 | | | | | | | | |
| $B_2O_3Na_2O$ | | 3 | | | 1 | | 3 | | | | | | 10 | | | |
| $B_2O_3K_2O$ | 1 | | | 2 | | | | | | | | | | 1 | | |
| $B_2O_3CaO$ | | | 3 | | | 1 | | | | | | | | 1 | | |

TABLE 1-continued

| | | | | | | | | | | | | | | | | |
|---|---|---|---|---|---|---|---|---|---|---|---|---|---|---|---|---|
| $B_2O_3MgO$ | 1 | | | 1 | | | 1 | | | | | | | 1 | | |
| $P_2O_5Na_2O$ | | | 1 | | | | 1 | | | | | | | | | |
| $P_2O_5MgO$ | | | | 1 | | 1 | | 5 | | | 1 | | | | | 5 |
| $P_2O_5CaO$ | | | 2 | | 1 | | 2 | | | | | | | | 1 | |
| Refractory | | | | | | | | | | | | | | | | |
| Alumina | 0.3 | | 0.1 | | | | | 1.0 | | | | 0.5 | 1.0 | | | |
| Silica | | | | | 0.2 | | | | | | | 0.5 | | | | |
| Silicon carbide | | | | | | 0.3 | | | | | | | | 0.5 | | |
| Dispersion agent | | | | | | | | | | | | | | | | |
| Xanthane gum | 1.0 | 1.0 | 1.0 | | | | | 1.0 | 1.0 | 1.0 | 1.0 | | 1.0 | | | 1.0 |
| Methyl cellulose | | | | 1.0 | 1.0 | | | | | | | 1.0 | 1.0 | 1.0 | 1.0 | |
| Polyvinyl alcohol | | | | | | 1.0 | 1.0 | | | | | | | 1.0 | | |
| Water | 64.7 | 59 | 60.9 | 54 | 56.8 | 54.7 | 62 | 60 | 67 | 67 | 68 | 38 | 42 | 62.5 | 51 | 64 |
| Viscosity (CPS) | 630 | 610 | 700 | 520 | 510 | 540 | 600 | 610 | 630 | 611 | 590 | 490 | 800 | 890 | 590 | 510 |

| | Invention | | | | | | | | | Comparative Examples | | | | | |
|---|---|---|---|---|---|---|---|---|---|---|---|---|---|---|---|
| | No. | | | | | | | | | | | | | | |
| Composition | 17 | 18 | 19 | 20 | 21 | 22 | 23 | 24 | 25 | 1 | 2 | 3 | 4 | 5 | 6 |
| Colloidal inorganic substance | | | | | | | | | | | | | | | |
| Alumina sol | | | | 10 | | 10 | | 10 | | 30 | 30 | | | | |
| Silica sol | 30 | 30 | 30 | | 5 | | 5 | | 5 | | | 30 | 30 | | |
| Zirconium boride | | 10 | | 30 | 30 | 30 | 30 | 30 | 30 | | | | | 30 | 30 |
| Silicate, Borate, Phosphate | | | | | | | | | | | | | | | |
| $SiO_2Na_2O$ | 1 | | 3 | 10 | | | 1 | | | | | | | | |
| $SiO_2K_2O$ | | 1 | | | 1 | | | 10 | | | | | | | |
| $SiO_2CaO$ | 1 | | | | | 3 | | | | | | | | | |
| $B_2O_3Na_2O$ | | | | | 4 | | | | | | | | | | |
| $B_2O_3K_2O$ | 1 | | | | | 7 | | | | | | | | | |
| $B_2O_3CaO$ | | | | | | 1 | | | | | | | | | |
| $B_2O_3MgO$ | | | | 1 | | | | | 3 | | | | | | |
| $P_2O_5Na_2O$ | | 10 | | | | | 5 | | | | | | | | |
| $P_2O_5MgO$ | 1 | | | | | | | | 1 | | | | | | |
| $P_2O_5CaO$ | | 1 | | | | | 1 | 1 | | | | | | | |
| $Na_2OWO_3$ | | | | | | | | | | 1 | | | | | 1 |
| $B_2O_3PbO$ | | | | | | | | | | | 1 | 3 | | | |
| $B_2O_3WO_3$ | | | | | | | | | | 1 | | 5 | | | 3 |
| $P_2O_5V_2O_5$ | | | | | | | | | | | | | 1 | | |
| $P_2O_5Fe_2O_3$ | | | | | | | | | | | 1 | | | | |
| $BeF_2$ | | | | | | | | | | | | | | | 2 |
| $Na_2OMoO_3$ | | | | | | | | | | | 1 | 8 | | | |
| $NaFBeF_2$ | | | | | | | | | | | | | 1 | 1 | |
| Refractory | | | | | | | | | | | | | | | |
| Alumina | 0.5 | | | | 1.0 | | | | | | | | | | |
| Silica | | | 1.0 | | | | | | 1.0 | | | | | | |
| Silicon carbide | | | | | | 1.0 | | 1.0 | | | | | | | |
| Silicon nitride | | | | | | | | | | | | 1.0 | | 1.0 | |
| Boron nitride | | | | | | | | | | | 0.5 | | 0.5 | | |
| Iron oxide | | | | | | | | | | | | 1.0 | | | |
| Dispersion agent | | | | | | | | | | | | | | | |
| Xanthane gum | | | 1.0 | 1.0 | 1.0 | 1.0 | | | | 1.0 | 1.0 | | | | 1.0 |
| Methyl cellulose | 1.0 | 1.0 | | | | | 1.0 | 1.0 | 1.0 | | | 1.0 | 1.0 | | |
| Polyvinyl alcohol | | 1.0 | | | | 1.0 | | | | 1.0 | | | | 1.0 | 1.0 |
| Water | 64.5 | 46 | 65 | 48 | 58 | 46 | 57 | 47 | 59 | 66 | 65.5 | 51 | 66.5 | 67 | 62 |
| Viscosity (CPS) | 490 | 1000 | 480 | 470 | 495 | 1060 | 70 | 710 | 650 | 960 | 930 | 750 | 800 | 810 | 1095 |

*Contents shown in terms of wt %

TABLE 2

| No. | Strength of dried film | Anti-oxidation effect | State of separation of film after annealing |
|---|---|---|---|
| Invention | | | |
| 1 | ○ | ○ | ○ |
| 2 | ○ | ○ | ○ |
| 3 | ○ | Δ | ○ |
| 4 | ○ | ○ | ○ |
| 5 | ○ | ○ | ○ |
| 6 | ○ | ○ | ○ |
| 7 | ○ | Δ | ○ |
| 8 | ○ | ○ | ○ |
| 9 | ○ | ○ | ○ |
| 10 | ○ | ○ | ○ |
| 11 | ○ | ○ | ○ |
| 12 | ○ | ○ | Δ |
| 13 | ○ | ○ | ○ |
| 14 | ○ | Δ | ○ |
| 15 | ○ | ○ | ○ |
| 16 | ○ | ○ | ○ |
| 17 | ○ | ○ | ○ |
| 18 | ○ | ○ | ○ |

TABLE 2-continued

| No. | Strength of dried film | Anti-oxidation effect | State of separation of film after annealing |
|---|---|---|---|
| 19 | ○ | ○ | ○ |
| 20 | ○ | ○ | ○ |
| 21 | ○ | ○ | Δ |
| 22 | ○ | ○ | ○ |
| 23 | ○ | ○ | ○ |
| 24 | ○ | ○ | ○ |
| 25 | ○ | ○ | ○ |
| Comparative Examples | | | |
| 1 | ○ | Δ | X |
| 2 | ○ | Δ | Δ |
| 3 | ○ | ○ | X |
| 4 | ○ | Δ | Δ |
| 5 | ○ | ○ | Δ |

TABLE 2-continued

| No. | Strength of dried film | Anti-oxidation effect | State of separation of film after annealing |
|---|---|---|---|
| 6 | ○ | ○ | X |

Dried film
○: 100% deposited
Δ: 90~99% deposited
X: less than 90% deposited
Anti-oxidation
○: No scale
Δ: Scale 5% or less
X: Scale 10% or more
Separation
○: 100% separation
Δ: 95~99% separation
X: Separation 90% or less

What is claimed is:

1. An anti-oxidation agent for a continuous annealing of stainless steel strip comprising 25 to 45% by weight of a colloidal inorganic substance which can be crystallized at a temperature not higher than 1300° C.; 1 to 25% by weight of at least one other compound having a melting point not higher than 1300° C. selected from the group consisting of silicates, borates and phosphates; 1 to 5% by weight of a dispersion agent; and the balance substantially water.

2. An anti-oxidation agent according to claim 1, further containing at least one refractory material.

3. An anti-oxidation agent according to claim 1, wherein said colloidal inorganic substance is at least one member of the group consisting of alumina, silica, aluminum phosphate, zirconium silicate and zirconium borate.

4. An anti-oxidation agent according to claim 1, wherein said silicates, borates and phosphates are in the form of alkali metal salts or alkaline earth metal salts.

5. An anti-oxidation agent according to claim 1, wherein said dispersion agent is an organic polymer selected from the group consisting of corn starch, tapioca starch, sodium alginate, guar gum, xanthane gum, casein, gelatin, α-starch, dextrin, methylcellulose, ethylcellulose, hydroxy ethylcellulose, carboxymethyl cellulose, hydrocymethylproply cellulose, polyvinylalcohol, polypropylene glycol, polyethylene oxide, polyvinyl butyral and pullulan.

6. An anti-oxidation agent according to claim 2, wherein said refractory material is at least one member of the group consisting of alumina, silica, magnesia, zirconia and titania, or the group of composite oxides consisting of mullite, andalusite, chamotte, magnesite, spinel, dolomite, montmorillonite, kaolinite and sepiolite, or the group of carbides consisting of silicon carbide, titanium carbide, tungsten carbide, boron carbide and molybdenum carbide.

7. An anti-oxidation agent of claim 1 comprising 25 to 45% by weight of colloidal inorganic substance, 1 to 5% by weight of dispersion agent, 1 to 25% by weight of compound having a melting point not higher than 1,300° C. and the balance being water.

8. An anti-oxidation agent for a continuous annealing of stainless steel strip comprising a colloidal inorganic substance which can be crystallized at a temperature not higher than 1300° C.; at least one compound having a melting point not higher than 1300° C. selected from the group consisting of silicates, borates and phosphates; a dispersion agent.

* * * * *